US006053666A

United States Patent [19]

Irvine et al.

[11] Patent Number: 6,053,666

[45] Date of Patent: Apr. 25, 2000

[54] CONTAINMENT BARRIER PANEL AND METHOD OF FORMING A CONTAINMENT BARRIER WALL

[75] Inventors: John E. Irvine, Atlanta; John J. Yeosock, Dunwoody, both of Ga.

[73] Assignee: Materials International, Inc., Atlanta, Ga.

[21] Appl. No.: 09/033,782

[22] Filed: Mar. 3, 1998

[51] Int. Cl.[7] ..... E02D 5/14; E02D 5/02

[52] U.S. Cl. ..... 405/279; 405/274; 405/276; 405/281

[58] Field of Search ..... 405/274–281, 405/267

[56] References Cited

U.S. PATENT DOCUMENTS

| | | | |
|---|---|---|---|
| 972,059 | 10/1910 | Clarke . | |
| 999,334 | 8/1911 | Pearson | 405/281 |
| 1,411,905 | 4/1922 | Boardman | 405/278 |
| 1,422,821 | 7/1922 | Boardman et al. . | |
| 1,679,800 | 8/1928 | Wemlinger . | |
| 1,851,864 | 3/1932 | Nolte | 405/279 |
| 1,855,113 | 4/1932 | Nolte | 405/279 X |
| 1,884,686 | 10/1932 | Hilpert . | |
| 2,090,728 | 8/1937 | Heide . | |
| 2,968,931 | 1/1961 | McGrath . | |
| 3,247,673 | 4/1966 | Schneller . | |
| 3,822,557 | 7/1974 | Frederick . | |

(List continued on next page.)

FOREIGN PATENT DOCUMENTS

| | | | |
|---|---|---|---|
| 916315 | 8/1946 | France | 405/278 |
| 673476 | 3/1939 | Germany | 405/279 |

OTHER PUBLICATIONS

Steel Sheet Piling Handbook, Reference Data on Shapes, Materials, Performance and Applications, United States Steel Co., pp.: cover page, inside cover page, 5–7, 9, 12, 13, 28–53.

USS Steel Sheet Piling, United States Steel, including pages: cover page, inside cover page, 8–20 and 22–39.

Materials International, Inc., Atlanta, GA, GeoGuard Vinyl Sheet Piling Advertisement, 6 pp.

Materials International, Inc., Atlanta, GA, ShoreGuard Vinyl Seawalls Advertisement, 12 pp.

Waterloo Barrier, Inc., Rockwood, Ontario, Canada, Sealable Joint Sheet Piling Advertisement, 4 pp.

(List continued on next page.)

*Primary Examiner*—Dennis L. Taylor

*Attorney, Agent, or Firm*—Thomas, Kayden, Horstemeyer & Risley

[57] ABSTRACT

An extruded containment barrier panel (5) for use in forming a containment barrier wall about a waste material storage or disposal site is disclosed. The containment barrier panel has an elongate body panel (10) with a top end (11), a spaced bottom end (12), and a first side edge (14) and a spaced parallel second side edge (15) extending from the top end to the bottom end of the body panel. A C-shaped female connecting member (17) is formed along the first side edge of the body panel, and a complimentary male connecting member (22) is formed along the second side edge of the body panel, both of which extend the length of the body panel. The male connecting member is sized and shaped to be slidably received within a second one of the female connecting members for forming an interlocked edge-standing relationship with a second one of the barrier panels, and both of the male and female connecting members may be rotated with respect to one another when one of the containment barrier panels is being joined to a second adjacent one of he containment barrier panels to form a containment barrier wall. The male connecting member has least two elongate seal members (32, 33, 34) extending the length thereof, and constructed and arranged to be placed into sealing engagement with the female connecting member of the second barrier panel such that a fluid-tight seal will be formed between adjacent ones of the barrier panels for preventing the migration of groundwater and/or underground gases from out or into the waste material storage or burial site.

23 Claims, 8 Drawing Sheets

U.S. PATENT DOCUMENTS

| | | | |
|---|---|---|---|
| 3,999,392 | 12/1976 | Fukushima et al. . | |
| 4,632,602 | 12/1986 | Hovnanian | 405/128 |
| 4,674,921 | 6/1987 | Berger | 405/262 |
| 4,690,588 | 9/1987 | Berger | 405/262 |
| 4,808,039 | 2/1989 | Fischer | 405/281 |
| 4,863,315 | 9/1989 | Wickberg | 405/278 |
| 5,066,353 | 11/1991 | Bourdo | 156/300 |
| 5,106,233 | 4/1992 | Breaux | 405/128 |
| 5,145,287 | 9/1992 | Hooper et al. | 405/242 |
| 5,163,785 | 11/1992 | Zanelli et al. | 405/277 |
| 5,292,208 | 3/1994 | Berger | 405/281 |
| 5,333,971 | 8/1994 | Lewis | 405/281 |
| 5,360,293 | 11/1994 | Breaux et al. | 405/267 |
| 5,388,931 | 2/1995 | Carlson | 405/274 |
| 5,580,191 | 12/1996 | Egan | 405/262 |
| 5,584,610 | 12/1996 | Simpson et al. | 405/281 |

OTHER PUBLICATIONS

Canadian Metal Rolling Mills, Cambridge, Ontario, Canada, Case History No. W104 Advertisement, 2 pp.

Canadian Metal Rolling Mills, Cambridge, Ontario, Canada, Case History No. W106 Advertisement, 22 pp.

Waterloo barrier, Inc., Rockwood, Ontario, Canada, Site Data Sheet, 2 pp.

Waterloo Barrier, Inc., Rockwood, Ontario, Canada, Summary of Field Applications, 7 pp.

Northstar Vinyl, Woodstock, Georgia, "Introducing Northstar's Series 1900", Nov. 4, 1997, 2 pp.

Materials International, Inc., Atlanta, GA, ShoreGuard Vinyl Sheet Piling, 14 pp.

CONTAINMENT BARRIER PANEL AND METHOD OF FORMING A CONTAINMENT BARRIER WALL

FIELD OF THE INVENTION

The invention relates in general to an extruded plastic sheet piling type containment barrier panel adapted for use in constructing a containment barrier wall. More particularly, the invention relates to an extruded one-piece plastic containment barrier panel which is constructed and arranged to be placed in an interlocked edge-standing fluid-tight relationship with adjacent ones of said containment barrier panels for forming a fluid-tight containment barrier wall about a defined geographic area, for example a hazardous waste burial or storage site, or a landfill.

BACKGROUND OF THE INVENTION

The containment of hazardous materials, whether resulting from a spill of the materials, or from the burial of the materials in a landfill, is a matter of great concern. Toward this end, a great number of environmental laws have been enacted which require landowners to take affirmative steps to prevent the spread of pollutants and hazardous materials from migrating from the location of the material burial or storage site giving rise to a polluting or hazardous condition, and particularly with regard to the prevention of groundwater migration of the pollutants or hazardous materials as this can impact water quality in lakes and streams, as well as drinking water supplies in surrounding communities.

The use of both metallic and plastic sheet pilings to form retaining walls is well known. However, sheet piling is not well adapted for use in forming a fluid-tight containment barrier as most all sheet piling, by its nature, is intended to weep along the edge-standing joints of the adjacent ones of the sheet piling panels in order to prevent the buckling or failure of the retaining wall made out of such sheet piling due to groundwater build-up during rainy seasons, flood conditions, or ocean tides. Moreover, steel sheet piling is not well suited for use in forming an underground containment barrier for waste storage sites in that steel will eventually rust and corrode, allowing migration of groundwater therethrough. Even coated steel sheet piling may be subject to corrosion due to the inevitable scratching of the surface finish of the sheet piling as it is driven into the Earth, which ultimately leads to corrosion and/or the failure of the sheet piling used to construct the containment barrier wall.

Accordingly, the use of extruded plastic sheet piling for use in forming containment barriers has arisen, as plastic is much more resistant not only to corrosion, but also to the hazardous and/or toxic material being contained. One example of such a sheet piling is shown in U.S. Pat. No. 4,808,039 to Fischer which discloses a coupling mechanism for interconnecting sealing plates built into sealing walls, for example extruded plastic sheet piling, to be used as a containment barrier. In Fischer, however, a problem arises in the manner of sealing the sealing strip of the sealing plate to the mating portion of an adjacent sealing plate/sheet piling, especially after the sheet pilings have been driven in position about the waste burial or containment site, in that the sealing strip needs to be glued or hot welded to the mating portion which appears to be extremely difficult to accomplish, if not impossible, once the sheet pilings have been driven into the Earth.

U.S. Pat. No. 5,106,233 to Breaux discloses a hazardous waste containment system utilizing an extruded tubular sheet piling, which can be mated to adjacent ones of the sheet piling extrusion to form a wall about the waste burial site, whereupon a sealant, for example a silicon material, is injected into a seal receptor chamber formed by the mating of adjacent sheet pilings to one another in the effort to form a fluid-tight seal. Although this appears to be a workable approach to building a containment barrier wall about a waste burial site, the problem exists in that the seal receptor chamber into which the silicon, or other viscous sealant, is pumped could be obstructed by a rigid but porous rock, organic debris, or other material which would prevent the flow of the sealant along the length of the containment barrier, thus leaving holes within the barrier such that groundwater and gases could migrate into and out of the waste burial site.

Yet another barrier panel system is disclosed in U.S. Pat. No. 5,360,293 to Breaux, et al. which discloses an in-ground barrier member interlocking joint and seal system. Here, a joint/sealing system is provided for forming interlocked in-ground barrier members into an in-ground containment wall. The respective barriers, or barrier members each having a female member including a "U"-shaped gasket adapted to receive a longitudinally extending male member of a second barrier member, the gasket being fastened onto the female member into which the male members will be passed. Although this patent teaches a barrier member which overcomes the problem of injecting a sealant along the length of the barrier panels, the problem exists in that the gasket material must be somehow joined to the female end of the in-ground barrier member such that it will not be stripped out or otherwise damaged or destroyed while being driven into the Earth prior to receiving the male end of an adjacent in-ground barrier member such that a nonfluid-tight seal may result along a portion of the length of the joint between adjacent barrier members, again allowing groundwater and gases to migrate therethrough. Also, the material used to form the U-shaped gaskets is preferably a second material different than the plastic used to extrude the barrier members, which naturally increases material costs.

An alternate embodiment of Breaux, et al. discloses the co-extrusion of the gasket with the barrier member for an intermediate connecting piece having two female members along its opposed sides for receiving respective ones of the male members of adjacent barrier panels therein, thus requiring the use of two different types of barrier members to construct a containment barrier wall. Nothing is taught in Breaux, et al. as to whether the same material is to be used for extruding both the barrier member and the gaskets. It must be inferred, therefore, that a first plastic will be used to extrude the barrier member and a second elastomeric material used to extrude the gasket.

What is needed, but seemingly unavailable in the art, therefore, is a one-piece containment barrier panel extrusion which can be quickly and easily used to form a fluid-tight containment barrier wall about a defined geographic area, for example a landfill or a hazardous waste material burial site, which ensures that a fluid-tight seal is formed about the geographic area so that groundwater, surface water, or underground gases, for example methane, cannot migrate out of the waste material site. What is also required is such an improved containment barrier panel which does not require that a separate sealant be injected into a space defined between adjacent ones of the barrier panels after having been driven into the Earth about the waste material burial site, and/or which will not require that a gasket material, or other type of hydrophilic sealing material be applied or adhered to at least one side of such a barrier panel for forming a fluid-tight seal. Also, the need exists for such an improved containment barrier panel which can be used to form a containment barrier wall without requiring the use of differing designs of containment barrier panels such that a single type or design of the containment barrier panel can be used to construct the containment barrier wall about a hazardous waste material storage or burial site.

SUMMARY OF THE INVENTION

The present invention provides an improved containment barrier panel and a method of forming a containment barrier wall about a waste material burial or storage site which overcomes some of the design deficiencies of other extruded containment barrier panels and methods of using same to form containment barrier walls, known in the art. The present invention provides a simplified one-piece plastic extrusion having an integral sealing device, the sealing device comprising at least one elongate rib, or ribs, or at least one elongate wiper seal, or wiper seals, and/or a combination of such ribs and wiper seals, each extending the length of at least one of the side edges of each such containment barrier panel, the opposite side edge of each such barrier panel being sized complimentary to the sealing device for being passed over and/or receiving the sealing device therein to ensure that a fluid-tight seal is formed as the containment barrier panel is driven into the Earth about the waste material storage or burial site.

The ribs and seals which comprise the integral sealing device of the containment barrier panel of this invention are preferably extruded of the same material and at the same time as is the barrier panel, and thus the fears or concerns of an incomplete seal being formed along the length of the barrier panel is avoided in that a separate material need not be injected into the Earth between adjacent barrier panels after being driven into position, nor need users of the improved barrier panel of this invention be concerned with otherwise stripping or destroying all, or a portion of an elongate gasket extending the length of one of the side edges of the barrier panels. This, in fashion heretofore unknown in the art, provides a much greater degree of assurance that a fluid-tight containment barrier wall is constructed for greatly reducing, if not entirely eliminating the migration of Groundwater and underground gases through the containment barrier wall, for example methane gases which are generated through the decomposition of waste materials in landfills. Another feature of the present invention is the ability to use a single extrusion for forming a containment barrier wall about a waste burial site without requiring the use of second or differing type or design of an extruded containment barrier panel to complete formation of the containment barrier wall.

The unique containment barrier panel of this invention has an elongate body panel with a top end, a spaced bottom end, a first side edge, and a spaced, parallel second side edge, each such side edge extending from the top end to the bottom end of the body panel. A C-shaped female connecting member is formed along the first side edge of the barrier panel and extends the length thereof. A complimentary T-shaped male connecting member is formed along the second side edge of the barrier panel and also extends the length thereof. The T-shaped male connecting member is sized and shaped to be fit within a respective one of the female connecting members for forming an interlocked edge-standing relationship between adjacent barrier panels.

Provided along the length of each male connecting member is an integral sealing device, preferably extruded with the body panel, the sealing device more particularly being an elongate rib, or ribs, or an elongate wiper seal, or wiper seals, or more preferably a combination of at least one elongate rib and a pair of wiper seals extending the length of the T-shaped male connecting member, and which will be sealingly engaged upon an elongate C-shaped channel formed by the C-shaped female connecting member of an adjacent barrier panel as the male connecting member is passed along the length of the female connecting member.

In its preferred embodiments, the sealing device of the containment barrier panel extrusion of this invention will thus include at least two elongate seal members extending the length of the male connecting member. The at least two elongate seal members may comprise at least two spaced and parallel ribs, or at least two spaced and parallel wiper seals or preferably a combination of at least one rib and at least one wiper seal, each extending the length of the male connecting member. Two variations of this latter embodiment of the invention are provided in which the male connecting member will have at least one rib and two wiper seals, the at least one rib and two wiper seals being spaced from and parallel to one another, and in a second variation the male connecting member of the containment barrier panel will include two ribs and two wiper seals with the ribs and the wiper seals being spaced from and parallel to one another.

As a male connecting member is passed along and received within a C-shaped female connecting member of an adjacent barrier panel, at least three lines of contact spaced from one another and each extending the length of the male connecting member on the second female connecting member are formed to ensure that a continuous fluid-tight seal is realized. Additionally, the male connecting member is formed about a longitudinal axis of rotation, and the male and/or the female connecting member may be rotated about this axis as the female connecting member is passed over the male connecting member of an adjacent barrier panel for use in constructing a containment barrier wall to encircle a defined geographic area, for example a hazardous material storage/burial site, or a landfill.

The containment barrier panel of this invention will preferably be a one-piece plastic extrusion, the plastic being selected from one of the group of plastics consisting of polyvinylchloride, polyethylene, polypropylene and polyurethane.

It is, therefore, an object of this invention to provide an improved containment barrier panel which will ensure that a fluid-tight seal is formed between adjacent ones of such containment barrier panels as the containment barrier panels are joined to one another for forming a containment barrier wall about a defined Geographic area.

It is another object of the present invention to provide an improved containment barrier panel, and method of using such containment barrier panels, for simplifying the process of constructing a containment barrier wall about a defined geographic area while ensuring that a fluid-tight seal between adjacent ones of the barrier panels results during construction of the containment barrier wall.

Yet another object of the present invention is to provide an improved and simplified method of constructing a fluid-tight containment barrier wall about a defined Geographic area.

Still another object of the present invention is to provide an improved containment barrier panel which will be simple in design and construction, rugged and durable in structure and use, and which will be resistant to the corrosive effects of the environment and of the buried hazardous and/or waste materials about which the containment barrier panel is placed.

An additional object of the present invention is to provide an improved extruded containment barrier panel where identical barrier panels can be used to form a containment barrier wall about a defined geographic area without the need to use extrusions of a second, or differing, construction in order to complete the construction of the containment barrier wall.

These, as well as the other objects, features, and advantages of the present invention will become apparent, therefore, upon reading the following specification, when taken in conjunction with the accompanying drawings.

DETAILED DESCRIPTION OF THE PREFERRED EMBODIMENTS

Figure 1:
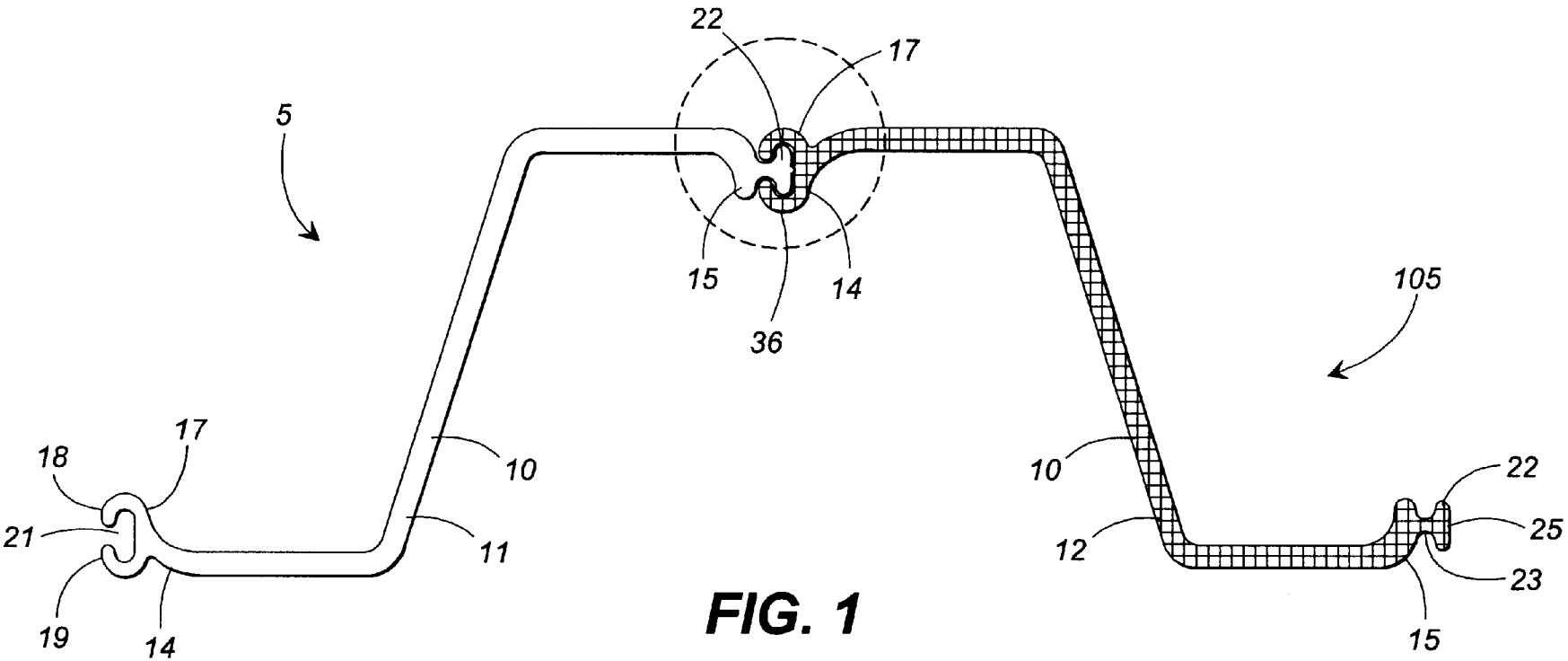
FIG. 1 is a top plan view of a first embodiment of the containment barrier panel of this invention in which a pair of identical containment barrier panels are mated to one another in an interlocked edge-standing fluid-tight relationship.

Referring now to the drawings, in which like reference characters indicate like parts throughout the several views, numerals 5 and 105 of FIG. I illustrate two identical containment barrier panel extrusions placed in a top end to bottom end interlocked edge-standing fluid-tight sealing relationship. As shown in FIG. 1, containment barrier panels 5, 105 each include an elongate planar body panel 10 having a top end 11 and a spaced bottom end 12. Extending between the respective top and bottom ends is a first side edge 14, and a spaced, parallel, second side edge 15. A substantially C-shaped female connecting member 17 is formed, and extends, along the first side edge 14 of the body panel. The female connecting member has a pair of spaced lips 18 and 19 extending the length of the body panel which define an elongate substantially C-shaped channel 21 which also extends the length of the body panel. A complimentary T-shaped male connecting member 22 is defined and extends, along the second side edge 15 of barrier panels 5, 105. As stated above, these two barrier panels are identical in construction, except that in FIG. 1 barrier panel 105 is shown with its bottom end 12 facing upwardly such that containment barrier panel 5 and containment barrier panel 105 are in the described top end to bottom end interlocked edge-standing fluid-tight sealing relationship. Each of the containment barrier panels 5, 105 of FIGS. 1 and 6 has a generally Z-shaped profile similar to that disclosed in U.S. Pat. No. 5,145,287 to Hopper, et al. entitled Plastic Panel Erosion Barrier, the provisions of which are incorporated herein by this reference. As such, the containment barrier panels can be placed in a top end to bottom end relationship for forming the stepped profile shown in FIGS. 1 and 6, or they can be placed in a top end to top end relationship such that they form a substantially continuous Z-shaped profile extending the length of the containment barrier wall constructed from respective ones of the described containment barrier panels.

Figure 2:
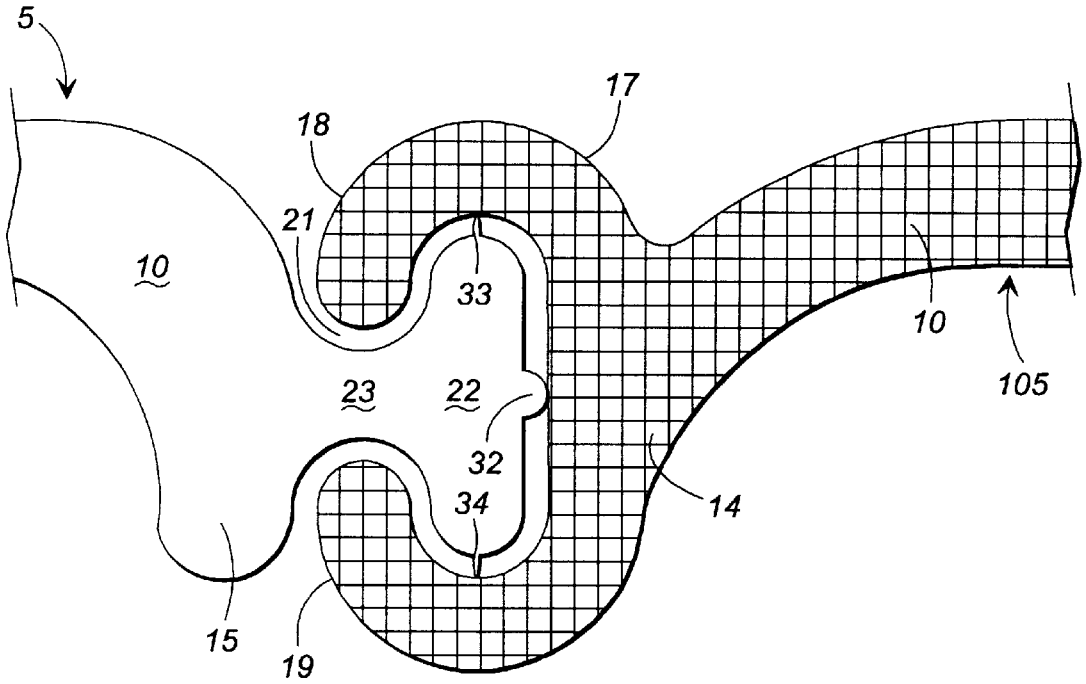
FIG. 2 is a partial top plan view along line 2—2 of FIG. 1.
Figure 3:
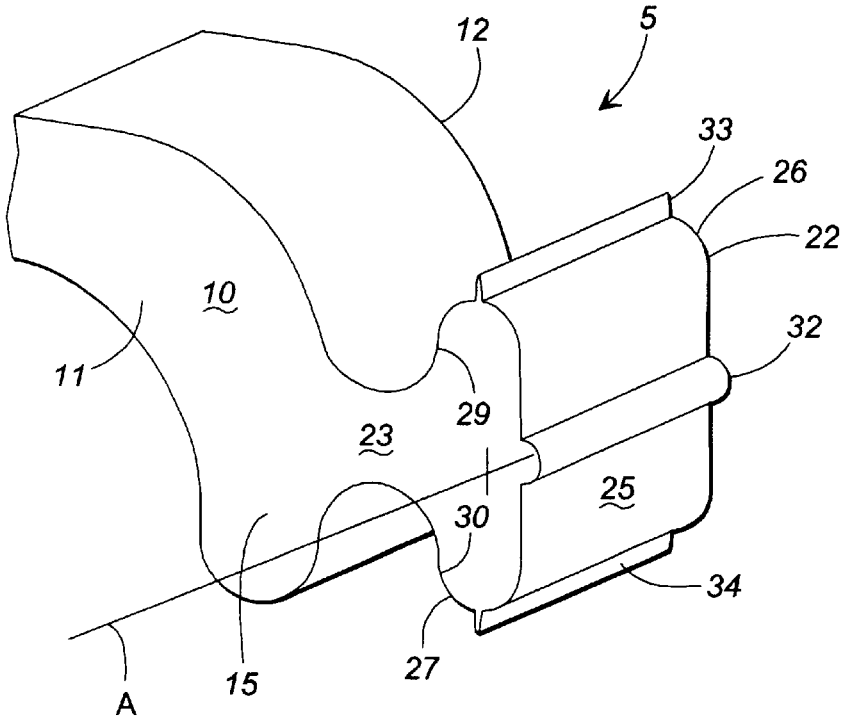
FIG. 3 is a partially cut away perspective view of the male connecting member of the containment barrier panel of FIG. 1.

As best shown in FIGS. 1–3, the T-shaped male connecting member 22 extends from the second side edge 15 of the body panel along an elongate neck 23 sized and shaped to pass between the opposed lips 18, 19 of the female connecting member 17, and has a front surface 25, a pair of opposed side surfaces 26, 27, and a pair of rear surface portions 29, 30 defined by neck 23. Positioned on the front surface 25 of the male connecting member in FIGS. 1–5 is an elongate raised rib 32 extending the length of the male connecting member. A pair of spaced and parallel wiper seals 33, 34 also extend along the length of the respective side surfaces 26, 27 of the male connecting member.

It is anticipated that after a first one of the containment barrier panels has been driven into the Earth, in much the same fashion as would any conventional extruded plastic sheet piling, for example a mandrel may be used to guide the containment barrier panel downwardly and inwardly into the Earth, that the female connecting member 17 of a second containment barrier panel will be positioned over and at least partially about the top of the T-shaped male connecting member of the first barrier panel, and will be slidably driven along the length of the male connecting member such that each of rib 32 and wiper seals 33 and 34, respectively, or at least two of the three thereof, will be engaged in sealing fashion along the inside C-shaped surface of channel 21. Rather than passing the female connecting member about and along the male connecting member as the second barrier panel is driven into the Earth as described above, however, it is anticipated that, and if so desired, the male connecting member of the second barrier panel could be positioned within the top of channel 21 of the female connecting member of the first barrier panel whereupon the second barrier panel will then be driven into the Earth adjacent the first barrier panel, and which may be caused to happen with any of the embodiments of the invention described herein and shown in FIGS. 1–14.

Figure 4:
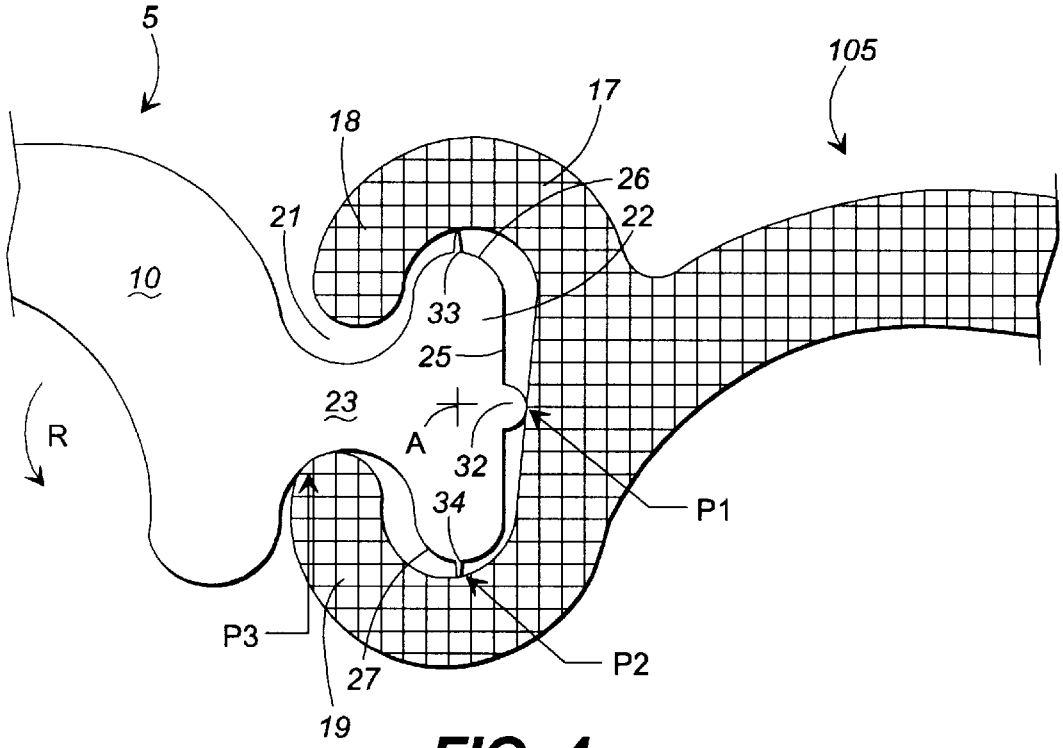
FIG. 4 is a partial top plan view of the male connecting member of the containment barrier panel of FIG. 1 rotated in a counterclockwise direction within the female connecting member of a second such containment barrier panel.
Figure 5:
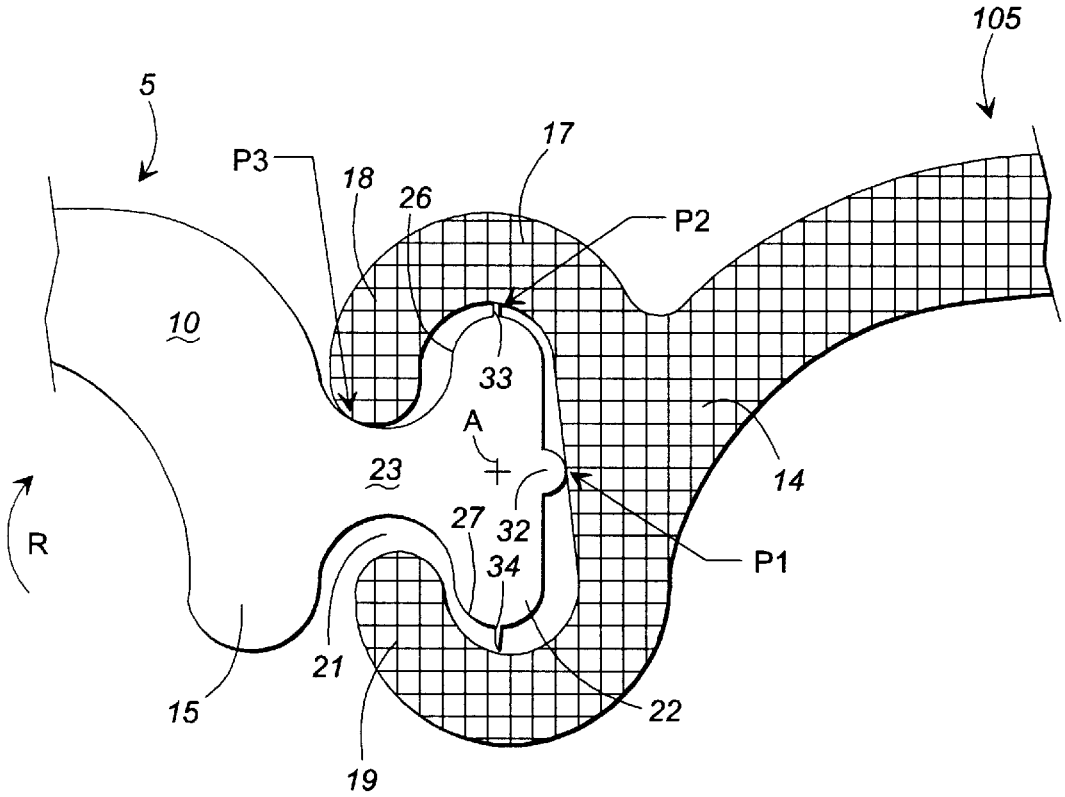
FIG. 5 is a partial top plan view of the male connecting member of the containment barrier panel of FIG. 1 rotated in clockwise direction within the female connecting member of a second such containment barrier panel.

As shown in FIGS. 2, 4, and 5, therefore, three lines of contact $P_1$, $-P_3$, represent the lines where rib 32, and wiper seals 33, 34, respectively, engage the inside surface of channel 21 and extend the length of the male connecting member 22 within the female connecting member 17. Also, due to the construction of the male connecting member, to include rib 32 and wiper seals 33, 34, it is anticipated that the female connecting member of the second barrier panel can be relatively easily driven the length of, or at least substantially along the length of, the male connecting member of the first barrier panel such that a continuous fluid-tight seal will be formed along the length of the female connecting member of the second barrier panel due to the fact that no separate material need be injected into channel 21, nor that any separately provided gasket, or other hydrophilic material, need be fastened or otherwise placed into channel 21 for the purpose of sealing male connecting member 22 on female connecting member 17. Moreover, the relatively narrow cross-section of rib 32 and wiper seals 33 and 34 will help to ensure that they cut through the Earth as the containment barrier panel is driven into the Earth, and along the female connecting member if so desired, to ensure that a fluid-tight seal is formed between adjacent ones of the containment barrier panels.

The unique construction of the containment barrier panel 5, 105 of this invention eliminates the need for a second or differing type of extrusion to construct a containment barrier panel as with the hazardous waste containment system of Breaux, U.S. Pat. No. 5,106,233. This is accomplished, as shown in FIGS. 4 and 5, by rotating either the male or female connecting member about a longitudinal axis of rotation A about which the male connecting member is formed, as a second containment barrier panel is being driven into and slid along a respective one of the female or male connecting members 17–22, respectively, of a second containment barrier panel. It is anticipated that due to the clearance of neck 23 between lips 18 and 19 of the female connecting member, that the connecting members can be rotated about the axis of rotation relative to each other through an angle of approximately 6° to 7°. Assuming, for example, that the male connecting member is rotated about its longitudinal axis A through an angle of 6° with respect to the female connecting member, then sixty such containment barrier panels would be required to form a circular containment barrier wall about the waste material site. The degree of rotation about axis A, however, can be varied by either extruding lips 18 and 19 such that the opening of channel 21 facing outwardly and away from first side edge 14 is either greater or lesser, as desired, such that a greater or lesser angle of rotation may be attained when driving the female connecting member of a second containment barrier panel over the male connecting member of a first containment barrier panel. However, as discussed hereinabove, it is preferred that the female connecting member be constructed such that a 6° to 7° angle of rotation may be accomplished which will thus ensure that a fluid-tight sealing relationship of the male connecting member within the female connecting member occurs, as shown in FIG. 4, where, for example, three lines of contact $P_1$, $P_2$, and $P_3$, are formed by rib 32, wiper seal 34, and by the movement of neck 23 into engagement with lip 19 of the female connecting member when the male connecting member is rotated in a counterclockwise direction within channel 21.

As shown in FIG. 5, when rotated in a clockwise direction, at least three lines of sealing contact $P_1$–$P_3$ still exist, albeit between rib 32 and wiper seal 33 with the C-shaped channel 21 of female connecting member 17, and by neck 23 moved against lip 18 of the C-shaped female connecting member, respectively. Thus, as constructed in its first embodiment., at least two of the elongate seal members, i.e. rib 32 and/or seals 33, 34 will be engaged on the inside of the C-shaped channel 21 of the female connecting member no matter how the male connecting member is rotated within this channel. For example, as shown in FIGS. 1 and 2, when the barrier panels are positioned adjacent one another extending along a straight line, the three sealing lines of contact are formed by rib 32, and by wiper seals 33, 34 engaged on the inside of the channel 21. When one of the connecting members is rotated about the axis of rotation, at least rib 32, and at least one of wiper seals 33, 34 will be engaged on the inside of the C-shaped channel as the male connecting member, with one of lips 18, 19 engaging neck 23 in sealing fashion also.

Figure 6:
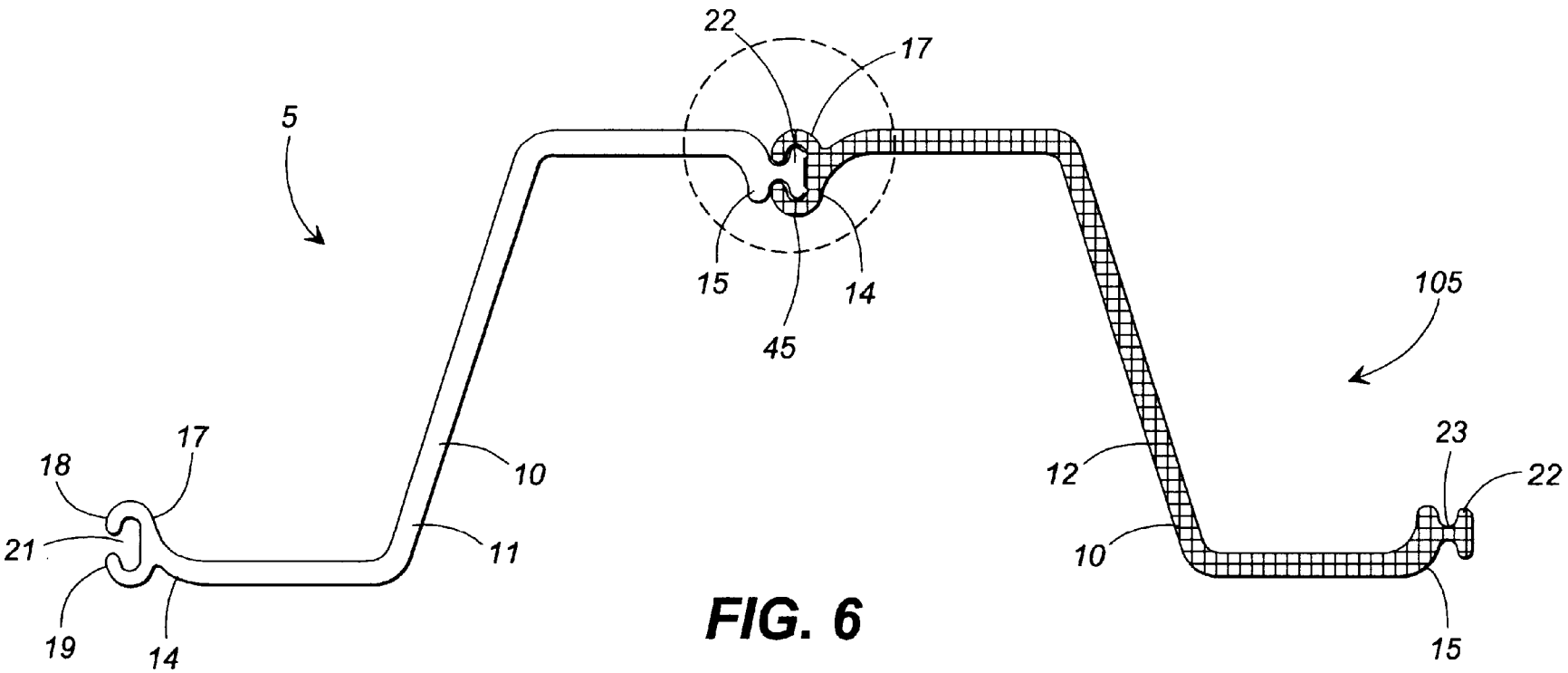
FIG. 6 is a top plan view of a second embodiment of the containment barrier panel of this invention in which a pair of identical containment barrier panels are mated to one another in an interlocked edge-standing fluid-tight relationship.
Figure 7:
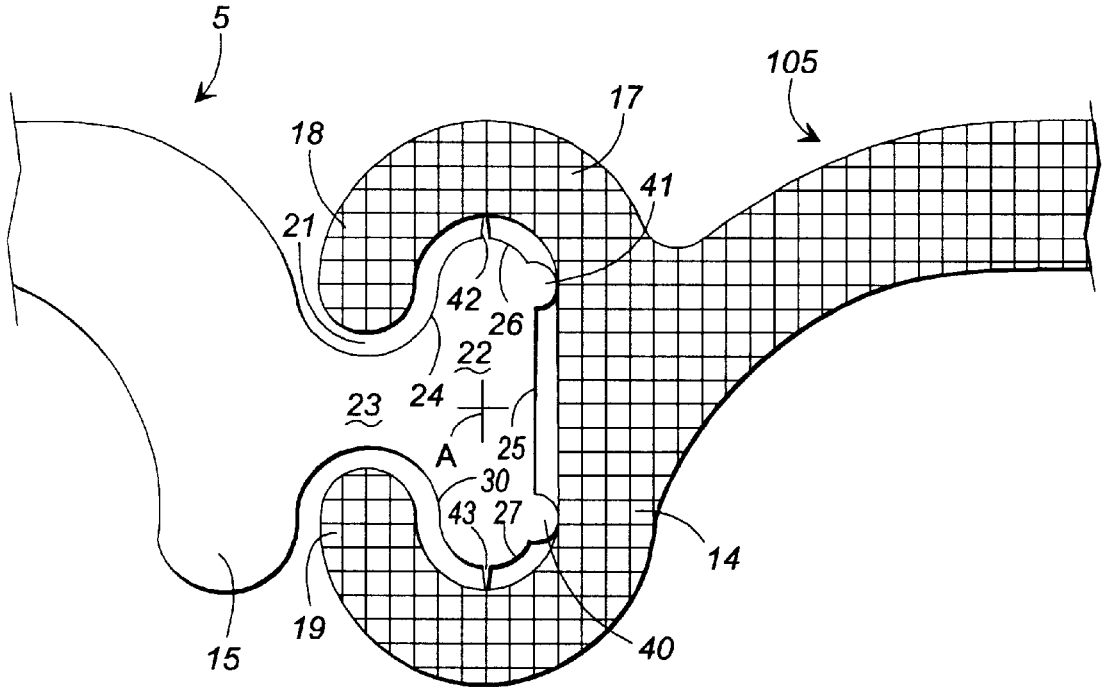
FIG. 7 is a partial top plan view along line 7—7 of FIG. 6.

A second embodiment of the containment barrier panel of this invention is illustrated in FIG. 6, which again illustrates two identical containment barrier panels 5, 105 placed in a top end to bottom end interlocked edge-standing fluid-tight sealing relationship. In fashion similar to the embodiment of containment barrier panels 5, 105 in FIG. 1, each containment barrier panel of FIGS. 6 and 7 has a planar body panel 10 with a top end 11 and a spaced bottom end 12, between which a first side edge and a spaced parallel continuous second side edge 15 extend. A C-shaped female connecting member is once again formed along the first side edge, having a pair of opposed lips 18, 19 defining channel 21 therebetween. A T-shaped male connecting member 22 again extends from a neck 23 along the second side edge 15, and has a front surface 25, two opposed side surfaces 26, 27, and two rear surface portions 29, 30 formed where neck 23 intersects the male connecting member. Like the embodiment of the containment barrier panel of FIGS. 1–5, however, and as best shown in FIGS. 7–10, here a pair of spaced and parallel ribs 40, 41 are formed on the front surface 25 of the male connecting member, and a pair of opposed wipers 42, 43 are formed on the opposed side surfaces 26, 27, respectively of the T-shaped male connecting member such that, as shown in FIGS. 6 and 7, there are four lines of contact extending the length of the male connecting member within the female connecting member which form the fluid-tight seal between the two containment barrier panels.

Figure 8:
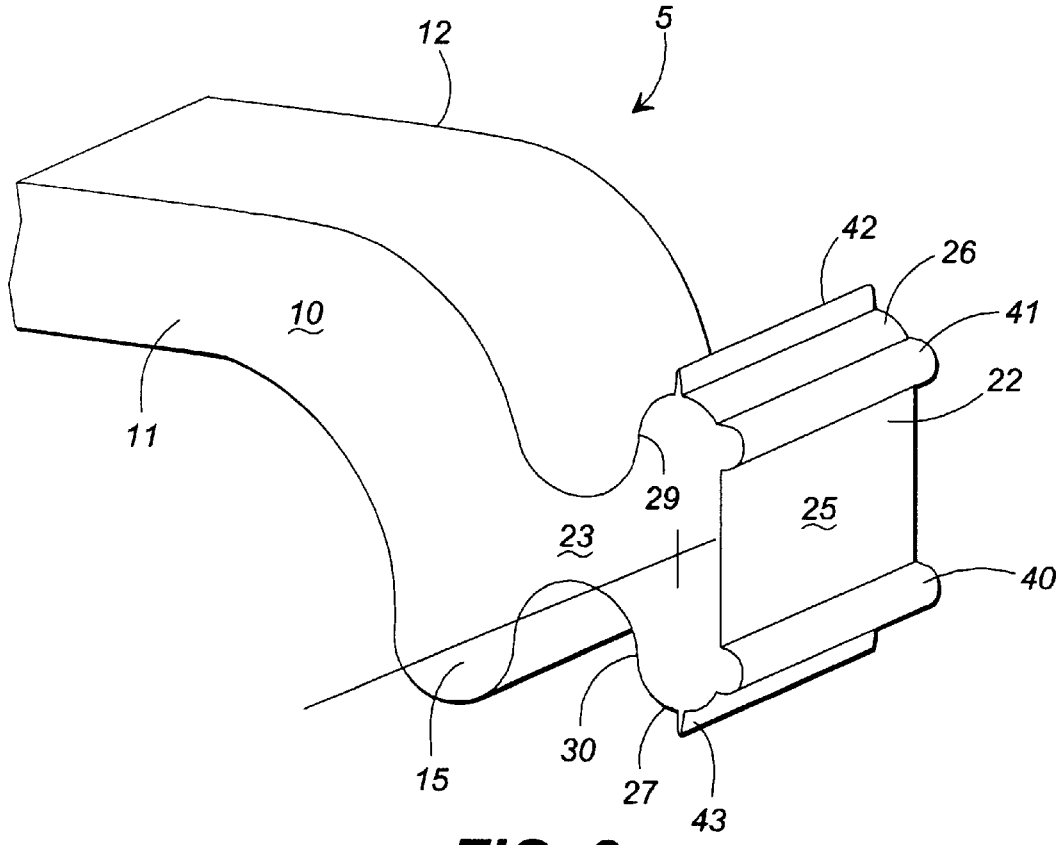
FIG. 8 is a partially cut away perspective view of the male connecting member of the containment barrier panel of FIG. 6.
Figure 9:
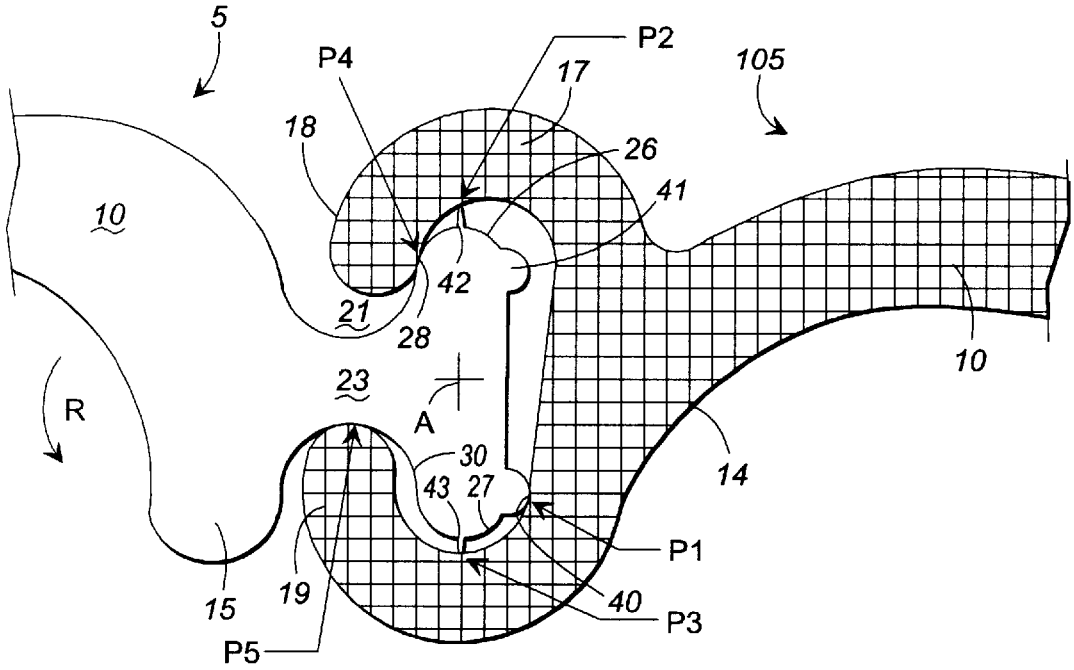
FIG. 9 is a partial top plan view of the male connecting member of the containment barrier panel of FIG. 6 rotated in a counterclockwise direction within the female connecting member of a second such containment barrier panel.
Figure 10:
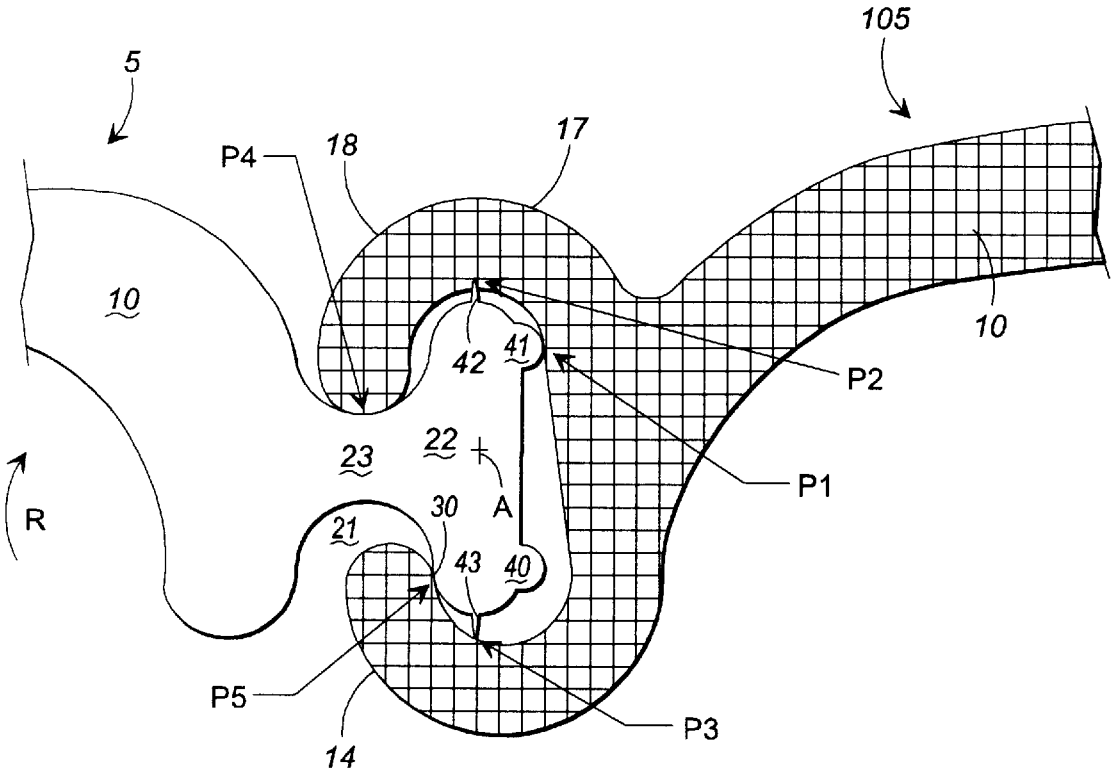
FIG. 10 is a partial top plan view of the male connecting member of the containment barrier panel of FIG. 6 rotated in a clockwise direction within the female connecting member of a second such containment barrier panel.

Referring now to FIGS. 8–10, as with the first embodiment of the containment barrier panel, the male connecting member 22 is formed about a longitudinal axis of rotation A such that either of the male or female connecting members may be rotated in a counterclockwise direction. FIG. 9, or in a clockwise direction, FIG. 10, when forming a containment barrier wall about a defined geographic area. In this embodiment of the invention, however, five lines of contact are established as the male connecting member is rotated within the female connecting member, as shown at points of contact $P_1$, $P_2$, and $P_3$, $P_4$, and $P_5$ in both of FIGS. 9 and 10, the only difference being that either rib 40, or 41 is engaged on the inside of channel 21, and neck 23 is engaged on either lip 19 (FIG. 9), or lip 18 (FIG. 10) of the female connecting member. Also, as shown in FIG. 9, the rear surface portion 29 of the male connecting member is engaged with the inside of lip 18 as neck 23 engages lip 19, and as shown in FIG. 10, the rear surface portion 30 is engaged with the inside of lip 19 as neck 23 engages with lip 18 to form the fifth sealing point of contact $P_5$, along the length of the male connecting member within the female connecting member.

As with the embodiment of the barrier panel shown in FIGS. 4 and 5, it is anticipated that the connecting members can be rotated relative to each other through an angle of approximately 6° to 7° about axis A, although this may be varied dependent upon the construction of the female connecting member and the male connecting member, respectively, as described above.

Figure 11:
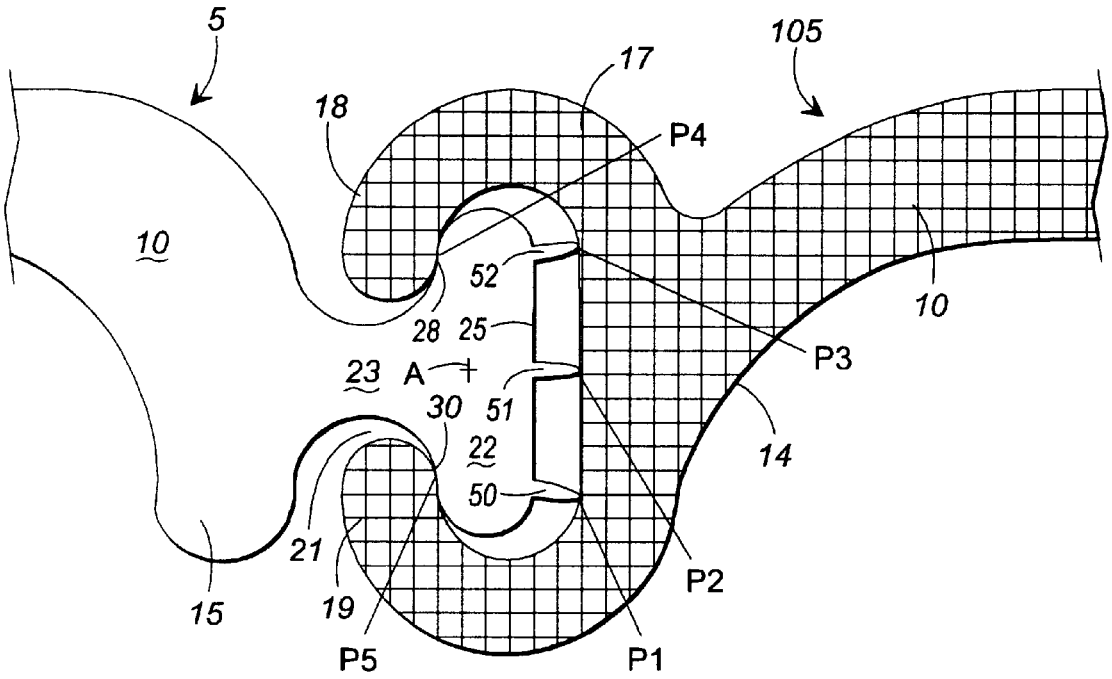
FIG. 11 is a partial top plan view of a third embodiment of the containment barrier panel of this invention.

A third embodiment of the containment barrier panel of this invention is shown in FIG. 11, in which the male connecting member is provided with three spaced, parallel, and elongate wiper seals 50, 51, 52, each of which extends along the length of the front surface 25 of the male connecting member. In FIG. 11 when the two barrier panels 5, 105 are placed in an aligned position, for example extending along a straight line, it is conceivable that five lines of contact $P_1$–$P_5$ can thus be attained at the ends of the respective wiper seals 50–52, and where the rear surface portions 29, 30 engage the inside surfaces of lips 18, 19 respectively.

Should the female connecting member of one of the two containment barrier panels of FIG. 11 be rotated about the longitudinal axis A of the male connecting member, as they are constructed to do in the fashion described above for the prior two embodiments of the barrier panel, it is anticipated that at least two of the three wiper seals 50–52 will remain in sealing engagement with the inside surface of channel 21, and that neck 23 may be engaged on either lip 18, or lip 19, respectively, dependent upon the direction of rotation, for forming a third line of contact between the barrier panels to again assure that a fluid-tight relationship is formed no matter how the connecting members may be rotated with respect to each other. Again, as with the embodiment of the containment barrier panel of FIGS. 1–10, due to the extrusion of wiper seals 50–52 with the barrier panel 5, 105, and due to their knife-like cross-section or profile, the female connecting member will be allowed to easily pass along the length of the male connecting member in relatively unimpeded fashion to form the interlocked edge-standing fluid-tight seal between respective ones of the containment barrier panels.

Figure 12:
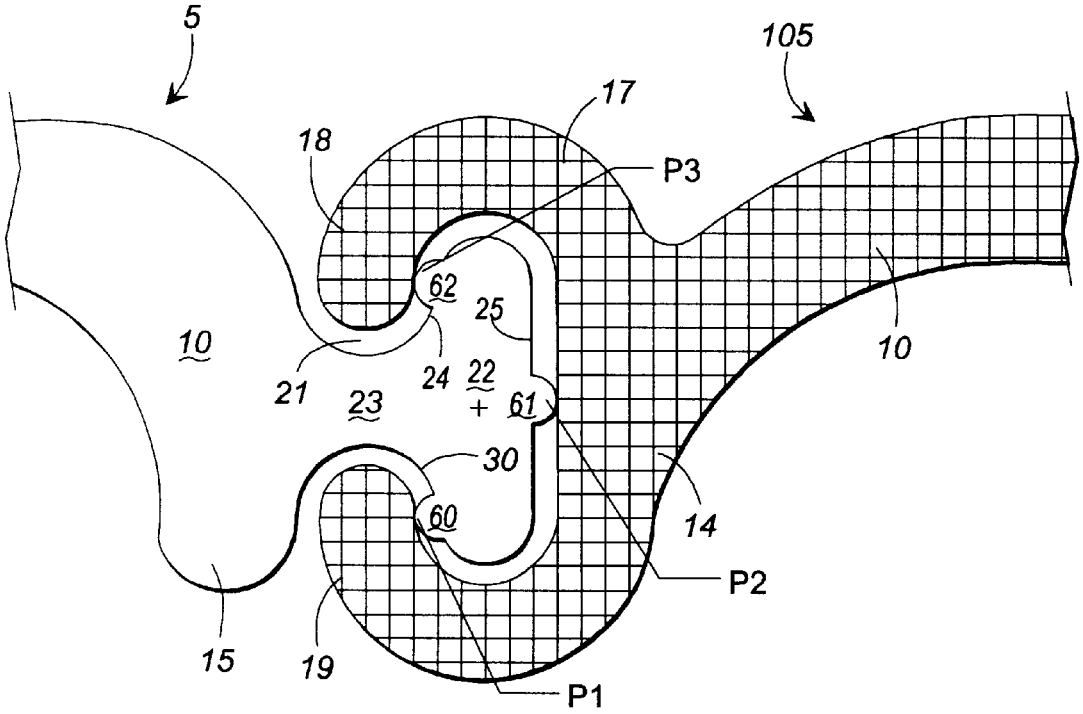
FIG. 12 is a partial top plan view of a fourth embodiment of the containment barrier panel of this invention.

A fourth embodiment of the containment barrier panel of this invention is illustrated in FIG. 12, in which three elongate ribs 60-62 are provided on the front surface 25, and the two rear surface portions 29, 30 of T-shaped male connecting member 22. Each of these three ribs is engaged on the inside of the channel 21 of the female connecting member, with ribs 60, 62 extending from rear surface portions 29, 30, into engagement with the inner surfaces of lips 18, 19, respectively. As with the embodiment of the containment barrier panel in FIGS. 1–11, the male and female connecting members can be rotated about longitudinal axis A such that two of the three ribs 60–62 will remain in sealing engagement with the inside of channel 21. Again, and as before, dependent upon the degree of rotation of the male connecting member within the channel of the female connecting member, for example, it is possible that neck 23 could also be sealingly engaged on either of lips 18 or 19. Each of ribs 60–62 extends the length of the male connecting member, and also act to help center or guide the male connecting member within the channel of the female connecting member as the male connecting member is slid therein and therealong during construction of a containment barrier wall out of the containment barrier panels.

Figure 13:
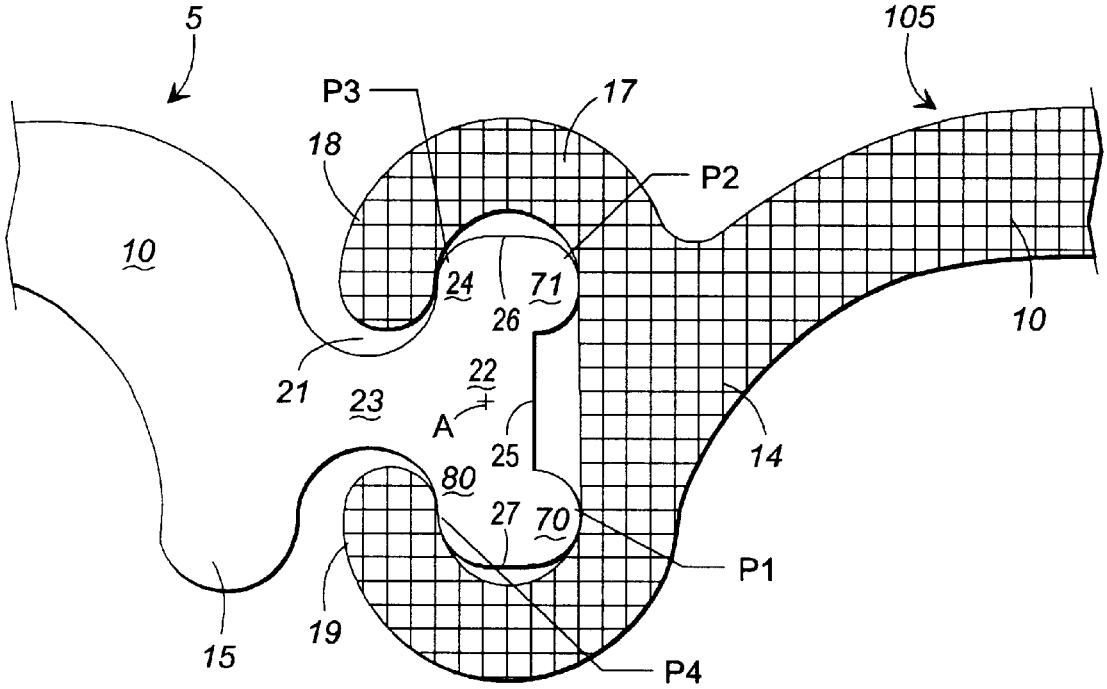
FIG. 13 is a partial top plan view of a fifth embodiment of the containment barrier panel of this invention.

A fifth embodiment of the containment barrier panel of this invention is illustrated in FIG. 13 in which a pair of spaced parallel ribs 70, 71, or nodes are formed where the side surfaces 26, 27 adjoin the front surface 25 of the male connecting member. So constructed, there are four lines of contact, denoted $P_1$–$P_4$ formed where the ribs 70, 71 engage the inner wall of channel 21, and where the rear surface portions 29, 30 of the male sealing member engage the inner surfaces of lips 18, 19, respectively. Unlike the previous embodiments of the containment barrier panel of the invention, male connecting member 22, due to its construction, is not intended for rotation about its longitudinal axis A, rather this type of construction is particularly well suited for straight containment barrier panel walls, whereupon one of the embodiments of the containment barrier panel of FIGS. 1–12 could be used to begin the formation of a curve or bend in the wall to encircle the waste disposal or burial site, about which the containment barrier is erected as the C-shaped female connecting member 17 has the same construction in all the embodiments of the containment barrier panel illustrated in FIGS. 1–14.

It is anticipated, however, that a slight degree of rotational bending could occur within the channel 21 of the female connecting member, but this would result in the deformation of either lip 18 or 19 by being urged outwardly and away from first side wall 14 of the body panel 10 of that extrusion such that only a very small degree of rotation could be attained. As with the embodiment of the invention illustrated in FIG. 12, the ribs 70, 71, as well as the rear surface portions 29, 30 would act to guide the male connecting member within channel 21 of the female connecting member.

Figure 14:
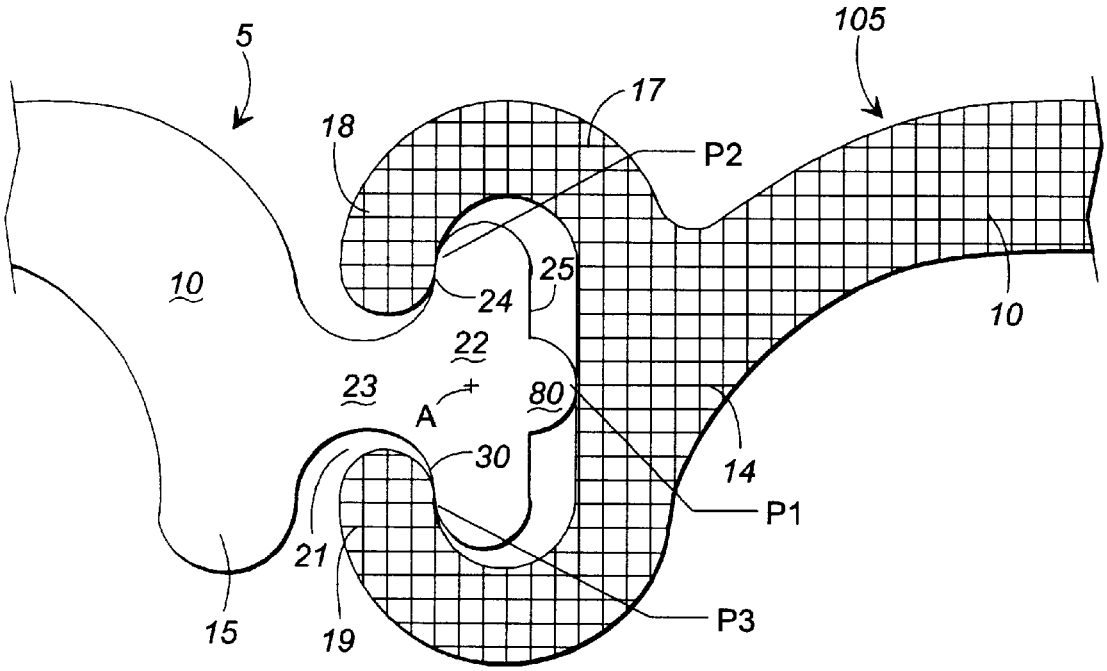
FIG. 14 is a partial top plan view of a sixth embodiment of the containment barrier panel of this invention.

A sixth embodiment of the containment barrier panel of this invention is illustrated in FIG. 14. In this embodiment of the invention only a single elongate raised rib 80 is formed on the front surface 25 of the T-shaped sealing member 22. This rib 80, however, is sized large enough to force the rear surface portions 29, 30 of the T-shaped male connecting member into sealing engagement with the inside surfaces of lips 18, 19 respectively of the female connecting member. As with the embodiment of FIG. 13, male connecting member 22 of FIG. 14 is not intended for rotation about a longitudinal axis A, rather it is more suited for a straight edge-standing relationship between adjacent ones of the barrier panels, for example a long straight run. However, and as with the embodiment of FIG. 13, it is anticipated that a slight degree of rotation could occur about longitudinal axis A although this would once again result in the outward deformation of either lip 18 or 19, and only a small degree of rotation could be attained while ensuring that the male connecting member remains in an interlocked edge-standing fluid-tight relationship with the female connecting member 17 of a second one of the containment barrier panels.

Each of the embodiments of the containment barrier panel of FIGS. 1–14 is preferably a one-piece plastic extrusion. It is anticipated that the ribs and wiper seals of the several above described embodiments of the invention will be extruded through the same die used to extrude the body panel, although it is possible that the wiper seals could be pre-formed and "hot welded" to the male connecting member of the containment barrier panel as it is being extruded. It is preferred that the containment barrier panel will be extruded of a polyvinylchloride ("PVC") plastic, although any rigid durable plastic material which is resistant to the elements and to corrosion caused by any waste materials or chemicals being contained will suffice for its construction. In addition to PVC, and by way of example, polyethylene, polypropylene, and/or polyurethane could also be used to extrude the containment barrier panel, although it is preferred that PVC be used due to its ready availability as a recycled material, thus lowering production costs and providing a more economically affordable and environmentally friendly product.

As described briefly above, a containment barrier wall constructed of the containment barrier panels of this invention will be constructed by driving a first containment barrier panel into the Earth at a predetermined position about the periphery or circumference of a defined geographic area that the user desires to isolate from the surrounding environs. After a first barrier panel has been driven into the Earth, the female connecting member 17 of a second barrier panel will be positioned with its bottom-most opening of channel 21 passed at least partially about the male connecting member 22 of the first barrier panel, and the second barrier panel will be driven into the Earth adjacent the first barrier panel while establishing and maintaining an interlocked edge-standing relationship of the two panels, and which will form a fluid-tight seal as the female connecting member, and more particularly the ribs, wiper seals, and/or ribs and wiper seals of the male connecting member become engaged on and along the length of the female connecting member. As described above, if so desired the male connecting member 22 of the second barrier panel may be passed within and along the female connecting member 17 of the first barrier panel rather than passing the female connecting member over the male connecting member.

A mandrel may be used, as desired to drive the containment barrier panels into the Earth, although a conventional end cap may also be used for driving the barrier panels into the Earth as would be done for conventional sheet piling. As subsequent containment barrier panels are placed in an interlocking edge-standing fluid-tight relationship with the previous ones of the barrier panels the sealing members may be rotated with respect to each other about the longitudinal axis of rotation A through the prescribed range of up to 6° to 7°, as desired, for forming an enclosure about the defined geographic area. For example, in a circular configuration the barrier wall would have a diameter of approximately 30 feet based on a nominal width of each barrier panel of 18 inches. Also, the respective barrier panels can be placed in a top end to top end relationship, or a top end to bottom end relationship forming either the stepped profile of FIGS. 1 and 6, or a Z-shaped profile, as desired. Moreover, although each one of body panels 10 is shown as having a generally Z-shaped profile, it is anticipated that other geometric profiles could be used, for example the body panel could be rectilinear or curvilinear, or have any other desired geometric shape formed so long as it has the appropriate female connecting member 17 defined along at least one side edge of the barrier panel extrusion, and the appropriate male connecting member 22, in its several embodiments described above, extending along the second side edge of each respective barrier panel extrusion.

Also, although not specifically illustrated within the drawings, it is anticipated that the body panel will have a thickness of from 0.20 inches up to 0.40 inches or greater, although the body panels can be of extruded in most any desired thickness based on the needs of the end-user, the length of the containment barrier panel to be extruded, the type of earthen material in which the barrier panel will be driven, as well as the chemical composition, i.e. the strength characteristics, and in particular the modulus of elasticity, of the plastic used to extrude the respective containment barrier panels.

So constructed, and so used, the improved containment barrier panel, and the containment barrier wall comprised of these panels, provides for a far greater degree of assurance that a fluid-tight containment barrier wall is formed about a hazardous waste material site, for example, than with the containment barrier panel systems known in the art in that no separate sealant is required to be injected along the length of the side edges of adjoining barrier panels, there is no possibility of a gasket being torn or dislocated, nor is there the requirement of a hydrophilic material being glued or cemented to, or injected along a side edge of the respective body panels to form a fluid-tight seal with adjacent ones of the barrier panels when placed in an interlocked edge-standing relationship therewith.

While preferred embodiments of the invention have been disclosed in the foregoing specification, it is understood by those skilled in the art that variations and modifications thereof can be made without departing from the spirit and scope of the invention, as set forth in the following claims. In addition, the corresponding structures, materials, acts and equivalents of all means or step plus function elements in the claims are intended to include any structure, material, or act for performing the functions in combination with other claimed elements, as specifically claimed herein.

We claim:

1. A containment barrier panel for use in forming a containment barrier wall, said containment barrier panel comprising:

an elongate body panel having a top end, a spaced bottom end, a first side edge and a spaced parallel second side edge, each said side edge extending from the top end to the bottom end of said body panel, respectively;

a female connecting member formed along said first side edge and extending at least partially the length thereof;

a male connecting member of complementary interlocking shape with respect to the shape of said female connecting member formed along said second side edge and extending at least partially the length thereof and sized and shaped to pivotably connect duplicate ones of said containment barrier panels together; and a sealing device extending the length of said male connecting member and formed as an integral part of said male connecting member and protruding from said male connecting member a distance sufficient to engage a portion of said female connecting member which is spaced away from said male connecting member for engaging and forming a fluid-tight seal with the female connecting member of a duplicate barrier panel;

whereby duplicate adjacent ones of said containment barrier panels can be arranged in edge-standing side-by-side relationship and slidably joined together along the respective interfitting male and female connecting members thereof to form a containment barrier wall with the engagement of the sealing device of the male connecting member with the female connecting member forming a fluid-tight seal of the containment barrier wall.

2. The barrier panel of claim 1, wherein said sealing device comprises at least two elongate seal members, each of which extends the length of said male connecting member.

3. The barrier panel of claim 2, wherein said at least two seal members comprise at least two spaced and parallel ribs.

4. The barrier panel of claim 2, wherein said at least two seal members comprise at least two spaced and parallel wiper seals.

5. The barrier panel of claim 2, wherein said at least two seal members comprise three spaced and parallel wiper seals.

6. The barrier panel of claim 2, wherein said at least two seal members comprise at least one rib and at least one wiper seal, said at least one rib and said at least one wiper seal being spaced from and parallel to one another.

7. The barrier panel of claim 6, wherein said at least two seal members comprise at least one rib and two wiper seals, said at least one rib and said two wiper seals being spaced from and parallel to one another.

8. The barrier panel of claim 6, wherein said at least two seal members comprise two ribs and two wiper seals, each said rib and each said wiper seal being spaced from and parallel to one another.

9. The barrier panel of claim 1, wherein said sealing device comprises an elongate rib extending the length of said male connecting member.

10. The barrier panel of claim 1, wherein said sealing device defines at least three lines of contact spaced from one another and each extending the length of said male connecting member for engagement with a female connecting member of a duplicate barrier panel.

11. The barrier panel of claim 1, wherein said male connecting member is formed about a longitudinal axis extending parallel to said body panel, said male and female connecting members each being sized and shaped for rotational movement relative to one another about said axis as the adjacent ones of said barrier panels are slidably joined together to form and maintain the interlocked edge-standing fluid-tight seal with the adjacent ones of said barrier panels.

12. The barrier panel of claim 11, wherein said sealing device comprises at least three spaced and elongate seal members each extending the length of said mail connecting member, and wherein said sealing device is constructed and arranged so that at least two or said at least three seal members stay in fluid-tight engagement with said female connecting member as the respective male and female connecting members are rotated about said axis with respect to each other.

13. The barrier panel of claim 12, wherein said at least three seal members comprise at least two spaced and parallel wiper seals.

14. The barrier panel of claim 12 wherein said at least three seal members comprise at least one rib and at least one wiper seal, said at least one wiper seal spaced from and parallel to said at least one rib.

15. The barrier panel of claim 11, wherein said sealing device defines at least three lines of contact spaced from one another and each extending the length of said male connecting member, and wherein at least two of said three points of contact remain in said interlocked edge-standing fluid-tight seal with the female connecting member of an adjacent one of said barrier panels during rotational movement of said respective connecting members about said axis relative to one another.

16. The barrier panel of claim 1, said barrier panel comprising a one-piece extrusion.

17. The barrier panel of claim 16, wherein said extrusion comprises a plastic extrusion, the plastic of said extrusion being selected from one of the group of plastics consisting of polyvinylchloride, polyethylene, polypropylene and polyurethane.

18. A containment barrier wall for placement about a defined geographic area for forming a fluid-tight containment barrier, said containment barrier wall comprising:

a) a plurality of duplicate containment barrier panels for being placed in an adjacent interlocking edge-standing relationship with each other;

b) each said barrier panel including:

i) an elongate body panel with a top end, a spaced bottom end, a first side edge and an opposed parallel second side edge, each said side edge extending from said top end to said bottom end of said body panel;

ii) a female connecting member defining a C-shaped channel formed along said first side edge and extending along the length thereof; and iii) a T-shaped male connecting member formed along said second side edge and extending along the length thereof and sized and shaped to be received in a female connecting member of a duplicate barrier panel and pivotably connect said female and male connecting members together;

c) wherein said T-shaped male connecting member is sized and shaped to be slidably received within a C-shaped channel of a female connecting member of an adjacent duplicate barrier panel to form an interlocked edge-standing relationship with an adjacent duplicate barrier panel; and d) a sealing device extending the length of said T-shaped male connecting member and formed as an integral part thereof and extending from said T-shaped male connecting member into said C-shaped channel of the female connecting member of a duplicate containment barrier a distance sufficient to engage a portion of said female connecting member that is spaced from said male connecting member for forming an interlocking fluid-tight seal with the female connecting member of an adjacent barrier panel.

19. The containment barrier wall of claim 18, wherein each said male connecting member is formed about a longitudinal axis extending parallel to its respective body panel, said male and female connecting members being sized and shaped for rotational movement with respect to one another about said axis as adjacent ones of said barrier panels are slidably joined together so as to maintain said fluid-tight seal therewith for forming said fluid-tight containment barrier wall.

20. The containment barrier wall of claim 19, wherein said sealing device comprises three spaced and elongate seal members each extending the length of each said male sealing member, and wherein at least two of said three sealing members stay in engagement with the female connecting member of the adjacent one of said barrier panels during rotational movement of said connecting members with respect to one another.

21. A method of constructing a fluid-tight containment barrier wall about a defined geographic area, the containment barrier including a plurality of duplicate containment barrier panels constructed and arranged to be driven into the earth about the geographic area, each barrier panel having an elongate body panel with a top end and a spaced bottom end, a first side edge and a parallel second side edge, each of the two side edges extending the length of the barrier panel, a female connecting member formed along the first side edge and a complementary male connecting member formed along the second side edge thereof, both connecting members extending the length of the barrier panel, said method comprising the steps of:

a) sliding the female connecting member of a first barrier panel lengthwise about and along the male connecting member of a second adjacent barrier panel;

b) in response thereto progressively engaging a seal member formed as a part of the male connecting member of the second barrier panel and extending the length thereof against the female connecting member of the first barrier panel to form a liquid seal between the adjacent barrier panels; and c) forming an interlocked edge-standing fluid-tight connection between the first and the second barrier panels in response thereto.

22. The method of claim 21, said seal member comprising at least three spaced and parallel seal members each extending the length of said male connecting member, and further comprising the step of engaging at least two of said at least three seal member against the female connecting member of the first barrier panel.

23. The method of claim 21, further comprising the step of rotating said first barrier panel with respect to the second barrier panel about a longitudinal axis extending through said male connecting member and maintaining the engagement of said at least two of said at least three seal members against the female connecting member of the first barrier panel in response thereto.

* * * * *